US007690690B1

(12) United States Patent
Campbell

(10) Patent No.: US 7,690,690 B1
(45) **Date of Patent: *Apr. 6, 2010**

(54) DISPLAY MEDIUM HAVING A BIBLIOGRAPHIC REFERENCE CORRESPONDING TO DATE

(76) Inventor: Steven R. Campbell, 1502 Aleyska Pt. Rd., Lampe, MO (US) 65681

( * ) Notice: Subject to any disclaimer, the term of this patent is extended or adjusted under 35 U.S.C. 154(b) by 8 days.

This patent is subject to a terminal disclaimer.

(21) Appl. No.: 12/004,863

(22) Filed: Dec. 22, 2007

Related U.S. Application Data

(62) Division of application No. 10/858,342, filed on Jun. 1, 2004, now Pat. No. 7,345,955.

(51) Int. Cl.
*B42D 5/04* (2006.01)
*G09D 3/00* (2006.01)
*G04B 19/24* (2006.01)

(52) U.S. Cl. ..... 283/2; 40/107; 40/121; 368/28

(58) Field of Classification Search ..... 368/10, 368/28, 29, 41, 43, 82, 223; 702/176–178; 40/119–122; 283/2–4
See application file for complete search history.

(56) References Cited

U.S. PATENT DOCUMENTS 2,282,630 A * 5/1942 Winford ..... 283/4
4,698,783 A 10/1987 Nishimuro et al.
4,906,982 A 3/1990 Gwynn
5,016,917 A * 5/1991 Dubner et al. ..... 283/4
5,090,733 A * 2/1992 Bussiere ..... 283/2
5,207,580 A * 5/1993 Strecher ..... 434/238
5,316,342 A * 5/1994 Almo ..... 283/2
5,690,364 A * 11/1997 Oleske et al. ..... 283/2
5,799,423 A * 9/1998 Malino ..... 40/107
6,202,035 B1 3/2001 Lameer
7,017,292 B1 * 3/2006 Abelarde ..... 40/110
7,090,253 B2 * 8/2006 Phillips et al. ..... 283/2
2003/0148776 A1 8/2003 Ciechanowiecki et al.
2003/0189877 A1 10/2003 Bubar
2003/0198138 A1 10/2003 Shebani
2004/0013043 A1 1/2004 Haq
2004/0159031 A1 * 8/2004 Chang ..... 40/800

OTHER PUBLICATIONS

PDAGreen.com—Time of Prayer Lite 1.0, Prayer Journal for Dec. 31, 2002.
Verseoftheday.com—Daily Wallpaper, Sample Image, Dec. 31, 2003.
Promotionalproductsandideas.com—Bible Verse Calendar, Dec. 31, 2003.

* cited by examiner

*Primary Examiner*—Vit W Miska
(74) *Attorney, Agent, or Firm*—Richard L. Marsh

(57) ABSTRACT

A daily display is associated with a text display, the daily display comprising a specific Gregorian calendar date, the text display comprising an abbreviated name of a text reference work wherein the text display is associated with the specific Gregorian calendar date to constitute a complete bibliographic citation.

10 Claims, 2 Drawing Sheets

DISPLAY MEDIUM HAVING A BIBLIOGRAPHIC REFERENCE CORRESPONDING TO DATE

CROSS REFERENCE TO RELATED APPLICATIONS

This application is a division application of Applicant's application Ser. No. 10/858,342 filed on Jun. 1, 2004, now U.S. Pat. No. 7,345,955, and claims the priority date of the parent application.

BACKGROUND OF THE INVENTION

1. Field of the Invention

This invention relates to a daily reminder having a bibliographic reference corresponding to the month and date. The daily reminder may be a digital time device, a desk, wall, pocket or daily calendar, a portable telephone or a personal data assistant.

2. Prior Art Statement

It is difficult to memorize a scriptural verse without ready reference to a print or audio version because the entire reference work containing the print version must be carried, or even when transcribed to a pocket size, it still must be retrieved from a pocket or purse. An audio version is often more cumbersome as it must be retrieved from a recording device wherein the user would need to load the recording, search for the location and play the device. In addition, in most work areas, audible recordings played on a device connected to a speaker would disrupt the surrounding work.

It is known to provide a desktop calendar/clock display that has a proverb randomly selected for each day of the month. The selected proverbs do not correspond to the date and appear without bibliographic reference data. Furthermore, only thirty-one proverbs would be needed to for any given month. For instance, see the U.S. Pat. No. 4,698,783 issued on Oct. 6, 1987 to Nishimuro, et al. Thus, there is a need for a daily reminder having a bibliographic reference corresponding to each date of each month of the entire year.

It is also known to provide a wristwatch that displays a message when randomly activated by movement of the user's arm. No bibliographic reference is displayed with the reference. Only one message is contemplated in this wristwatch though it may comprise a movable display to accommodate a message of a size greater than the available display. For instance, see the U.S. Pat. No. 4,906,982 issued Mar. 6, 1990 to Spencer Gwynn. Again, the message is not keyed to a specific date and no bibliographic reference is provided thus indicating a great need for a daily reminder having a bibliographic reference specifically corresponding to each date of each month of the entire year.

It is further known to provide a portable device that determines the specific time of day for Islamic prayers at any location by reference to global positioning signal (GPS). Direction of Mecca is indicated at a location on the face of the portable device by using the face of the device as a compass rose. No message is displayed though specific times are computed and indicated. An audible signal can also be produced to indicate the correct times for prayer. For instance, see U.S. Pat. No. 6,202,035 B1 issued Mar. 13, 2001 to Joep Lameer. A need exists for a daily reminder having bibliographic references corresponding to the specific date of the entire year.

Additionally, it is known to provide a cellular phone that gives the direction toward Mecca or any other direction as selected or preprogrammed. Scriptures or extracts of religious books may be displayed. Times for Islamic prayers may also be displayed and an alarm may be made to sound for the start or finish of prayers. For instance, see the U.S. Patent Publication 2003/0148776A1 published Aug. 7, 2003 to Ciechanowiecki, et al. Though passages may be indicated, the bibliographic reference and key to the day of the month are missing so there still exists a desire for a daily reminder having bibliographic references corresponding to specific dates.

Analog time displays having message areas arranged on the display face that may cite specific references indicative of the prayer to be offered are described in U.S. Patent Publications 2003/0189877A1 published on Oct. 9, 2003 by David N. Bubar and 2003/0198138A1 published on Oct. 23, 2003 by Ali Shebani. The watch of Bubar also has slots along the edge for inserting prayer reminders for specific prayers. The top of the edge of the watch is transparent to allow the user to observe the icon indicative of the prayer recipient or the prayer to be offered. Still, the devices of Bubar and Shebani do not provide for specific references corresponding to the exact date of the month.

Another known wristwatch has GPS capabilities and an imbedded chip to calculate and display the correct times for prayer for Muslims at any point in the world and to indicate the direction toward Mecca. The face of the dial changes color depending on the prayer to be offered. For instance, see the U.S. Patent Publication 2004/0013043 A1 published on Jan. 22, 2004 by Tanveer Ul Haq. Only the time for prayer and direction toward Mecca are provided and thus there is still a need for specific bibliographic references corresponding to each date of each month.

It is also known to provide software for PDA's to allow the user to insert scripture references, prayer requests, prayers and other journal entries for ready reference. Though the reference on the PDAGreen.com site fortuitously cites Psalms 31 for Dec. 31, 2002, the entire 31$^{st}$ chapter of Psalm is cited, not a specific chapter and verse for each day of each month. Therefore, the need for specific bibliographic references corresponding to every specific date still exists.

Verse of the day, an internet site provides a new Christian Bible verse and new wallpaper for each day when logging onto the Internet. The images on the wallpaper do not appear to be associated with the day of the month. Since, the verses are not related to the day of the month, there is still a desire for a daily reminder having a bibliographic reference corresponding to each date of each month.

Finally, it is known to provide a print calendar with a verse for every day is available from Promotional Products and Ideas of 1605 5th Avenue North, Suite 303, Seattle, Wash., 98109. Some dates may have verses corresponding to either the date or month, however, none are keyed to both the exact month and day and thus it is still novel to provide for a daily reminder having a bibliographic reference specifically corresponding to each date of each month of the entire year.

SUMMARY OF THE INVENTION

As no current daily reminder has exact correspondence of bibliographic references to the date, it is an object of this invention to provide a daily display and a text reference wherein the daily display has the bibliographic reference of the text associated with the specific date of the daily display. The bibliographic citation preferably includes a representation of the text reference work and a specific citation within the text reference work. It is also an object of this invention to provide a daily display and text display which has a specific text reference corresponding with every date of the Gregorian calendar.

Another object of this invention is to provide a daily bibliographic reference and text of the daily bibliographic reference upon a liquid crystal display such as the liquid crystal display of a digital watch. In the digital watch, the display of the date comprises an alphameric format for the day of the week and a numeric format displaying the month of the year and the date with a divider such as a colon (:) between the month and day. In the instant invention, the alphameric display is used to cite the reference work while the numeric display shows a specific citation within the reference work corresponding to the exact date. The text of the specific citation may then be displayed upon the liquid crystal display using a toggle button of the digital watch.

It is also an object of this invention to provide a display medium comprising an alphameric display of the day of the week and a numeric display of the month of the year and day of the month wherein the alphameric display further comprises a bibliographic citation to a reference work and the numeric display corresponds to a specific citation within the reference work.

Still another object of this invention is to provide a daily bibliographic reference and text of the daily bibliographic reference in a print format such as a wall calendar, desk calendar or pocket calendar. In accordance with the teachings of this invention, the daily bibliographic reference corresponds to the date, is cited thereupon and preferably also has the text of the daily bibliographic reference printed thereupon.

A feature of this invention is to provide a display medium which displays a daily bibliographic reference and text of the daily bibliographic reference wherein the display medium is an electronic calendar display. It is also a feature of this invention that the electronic calendar display is carried by an instrument which has means to toggle between the alphameric display of the day and the bibliographic citation. Preferably, the means to toggle comprises an exterior button which when depressed once, a representation of the bibliographic citation is displayed and when the button is depressed a second time, a representation of the alphameric display of the day is displayed.

One end of this invention is to provide an electronic calendar display which is adapted to alternately display a daily bibliographic reference and text of the daily bibliographic reference with a means to toggle wherein the means to toggle comprises an exterior button which when depressed once, the bibliographic citation is displayed and when the button is depressed a second time, the text of the bibliographic citation corresponding to the day of the week is displayed.

One aim of this invention is to provide an electronic calendar display medium within an instrument which has a means to toggle comprising an exterior button which is used to scroll through multiple bibliographic citations corresponding to the numeric display of the day by holding the button in a depressed position wherein a particular citation may be selected by releasing the button.

Still another feature of this invention is to provide a display medium carried by an instrument which is selected from the group comprising digital wristwatch, personal data assistant, portable computer, portable telephone, electronic billboard and desk top computer.

One goal of this invention is to provide a display medium carried by an instrument wherein the display medium is selected from the group comprising a liquid crystal display, a light emitting diode, a cathode ray tube, a plasma screen.

Yet another end of this invention is to provide a display medium having a means for displaying a representation of a day of the week, a numeric display of a month of the year, a numeric display of a day of said month, a numeric display of an hour of said day, a numeric display of minute of said hour wherein of the representation of the day of week, the numeric month of the year, the day of the month the hour of the day, the minute of the hour comprises a day/month/date/time display and wherein of the day/month/date/time display also comprises a bibliographic citation, the representation of the day portion of the day/month/date/time display is changeable to a representation of a reference work and the month/date portion of the day/date/month/time display corresponds to a specific citation within the reference work.

Finally it is a feature of this invention to provide display medium having a means for displaying a representation of the day portion of the day/month/date/time display which comprises two or three characters wherein of the day portion of the day/month/date/time display is changeable to a representation of a reference work in wherein the representation of the reference work also comprises two or three characters commensurate with the space available in the day portion of the day/month/date/time display.

DESCRIPTION OF THE PREFERRED EMBODIMENTS

While the various features of this invention are hereinafter described and illustrated as a daily display having the bibliographic reference of said text associated with the specific date of said daily display, it is to be understood that the various features of this invention can be used singly or in various combinations thereof to provide a daily display having a date specific bibliographic reference as can hereinafter be appreciated from a reading of this description.

Figure 1:
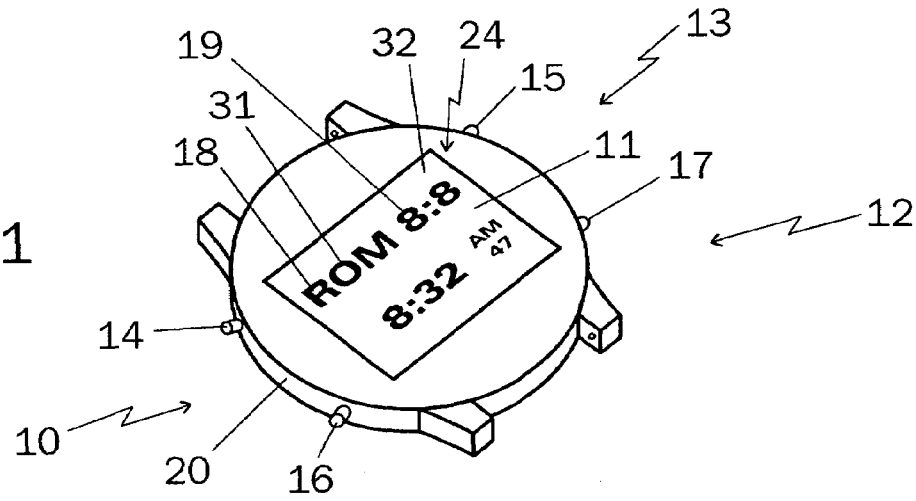
FIG. 1 is a plan view of the embodiment of a display medium showing a typical bibliographic reference corresponding to the date.
Figure 2:
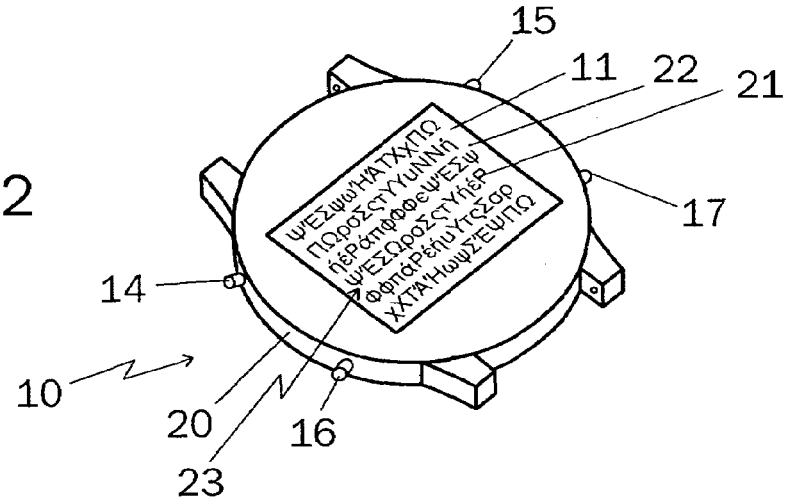
FIG. 2 is a plan view of the preferred embodiment showing the text of the typical bibliographic reference cited in FIG. 1 upon the display medium.
Figure 3:
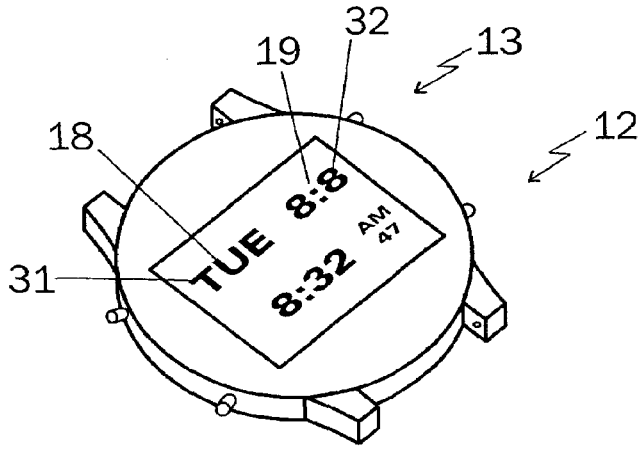
FIG. 3 is a perspective view of a wristwatch having the typical text of the day of the week and numeric display of the month and day of the year upon the display medium.

Referring now to FIGS. 1-3, a display medium 10 preferably comprises an instrument 100 having a display of the day of the week, hereinafter, daily display 32 and a display of a text reference, hereinafter, text display 31. In the instant invention, daily display 32 comprises a specific Gregorian calendar date and text display 31 selectively comprises an abbreviated name of a text reference or a day of the week. Text display 31, associated with the specific Gregorian calendar date displayed in daily display 32, constitutes a complete bibliographic citation for use by the user of display medium 10. In embodiments having an electronic display such as LCD (liquid crystal display), LCD 11 preferably has at least two lines 12, 13 of display, and as shown in FIG. 3, the day of the week, the month of the year and day of month are generally shown by the numerals in line 13 comprising text display 31 along with daily display 32 and the time display generally is shown by the numerals in line 12. The day/month/date display line 13 generally comprises an alpha designation 18 and a numeric designation 19. In the nominal display of day/month/date, alpha designation 18 comprises a two or three letter display of the day of the week and numeric designation 19 shows two characters each for the month and day of the month, however, in the instant invention, alpha designation 18 comprises a text display 31, referring to a book of Scripture in the Christian Bible, the book of Romans from the New Testament shown in FIG. 1. Numeric time display line 12 remains the same, however, when associated with new text display 31 also refers to the chapter and verse of the book of Romans which completes bibliographic citation 24. It is readily observed then that a complete bibliographic citation 24 from the book of Romans, Chapter 8, verse 8 corresponds directly to the eighth month (August) and eighth day thereof in line 13. Text display 31 and daily display 32 change with each new day and thus displays 31, 32 show a bibliographic citation 24 which corresponds directly to every month and date of the month throughout the year. With reference now to Table 1, bibliographic citations 24 from the Christian Bible for displays 31, 32 are shown which correspond exactly to the month and date for the entire year. Though table 1 shows a preferred bibliographic citation 24 for each month and date of the year, it should be fully understood that alternate bibliographic citations are available for most, if not all, month and date combinations.

When desired by the user, the actual text 23 corresponding to bibliographic citation 24 may be obtained by depressing a toggle key 14 which toggles between displays 31, 32, 12 and actual text 23 corresponding to the bibliographic citation 24, text 23 appearing as Greeking 21 in FIG. 2 upon the LCD 11. It is within the scope of this invention to provide for a scrolling text displayed in lines 13 and 12, however, in the preferred embodiment, the entire face 22 of LCD 11 shows the complete text in multiple lines of text and thus face 22 changes form when toggle key 14 is depressed. Text 23 of each of the corresponding bibliographic citations 24 is contained upon an electronic memory chip (not shown) resident within instrument 100 having display medium 10. It is also within the scope of this invention to provide different languages to be displayed as text 23 and for text display 31 of bibliographic citation 24.

Instrument 100 having LCD 11 may comprise a wristwatch 20 as shown in FIGS. 1-3 or a portable telephone, a personal data assistant or other electronic device, including, but not limited to, laptop computers, handheld computers, electronic calculators, electronic billboards; desktop computers and the like. With reference now to FIG. 1, digital wristwatch 20 has control buttons 14, 15, 16 and 17, control buttons 14-17 used to toggle between various displays on LCD 11. For instance, control button 14 is a bibliographic/text toggle, which is used to toggle between bibliographic citation 24 shown in FIG. 1 to the text of FIG. 2 shown by the Greeking 21 on LCD 11. Thus, the user of instrument 100 having LCD 11 as display medium 10 may be reminded of the bibliographic citation 24 for the day by reference to text display 31 and daily display 32 and may additionally refer directly to text 23 by toggling between two line display 12, 13 and text 23 using control button 14. The user of instrument 100 may then memorize text 23 or may simply refer to text 23 throughout the day for inspiration. Control button 15 may be used to toggle the bibliographic citation 24 of Romans, chapter 8, verse 8 to the day of week and day and month display thus showing, for instance, Friday, 8:8 referring to Friday, August eighth. Therefor, LCD 11 on instrument 100 functions both as a day and date reminder and a bibliographic citation 24 reminder for the user thereof. Toggle buttons 16 and 17 are used in a conventional manner to set the time of day shown on time display line 12 of LCD 11. Where larger displays are available, such as on electronic billboards, desktop or laptop computers, bibliographic citation 24 may be automatically displayed alternately with daily display 32, text display 31 and time reference line 12. For instance, it may be beneficial for religious centers to alternately display bibliographic citation 24, day/month/date line 13, time reference line 12 and text 23 upon an electronic billboard to call attention to a daily inspirational message associated with the specific Gregorian date.

The embedded electronic chip carried by instrument 100 preferably contains text 23 of all of the available bibliographic citations 24 and control buttons 14, 15 may be used together to display different bibliographic citations 24 for the specific date shown in line 13. For instance, every book of the Christian Bible has Chapter 1, verse 1 and therefor January first has sixty-six different references contained upon electronic chip and the user of instrument 100 may toggle through these sixty-six references to display a different bibliographic citation 24 for January first of the year, for instance, by depressing and holding control button 15. It would also be within the scope of this invention to first depress control button 14 and thereafter repeatedly depressing control button 15 to display alternate verses or employ other combinations of control buttons 14-17 to toggle between different verses for a single day. It should be readily apparent then that the user of instrument 100 may use the text 23 of any one of a number of bibliographic citations 24 for inspiration, memorization or citation throughout a single day or may select a particular text 23 for use throughout the day depending upon the user's preference. The bibliographic citations 24 shown in Table 1 are preferably preset at the factory where instrument 100 is manufactured, bibliographic citations 24 shown for each specific day of a calendar year.

TABLE 1

| JANUARY | FEBRUARY | MARCH | APRIL | MAY | JUNE |
|---|---|---|---|---|---|
| Genesis 1:1 | 1John 2:1 | 1John 3:1 | Eph 4:1 | Genesis 5:1 | Mic 6:1 |
| John 1:2 | Titus 2:2 | Col 3:2 | Mal 4:2 | 1Thes 5:2 | 2Cor 6:2 |
| Genesis 1:3 | 2Tim 2:3 | John 3:3 | 1Thes 4:3 | 1John 5:3 | Isaiah 6:3 |
| John 1:4 | 1Tim 2:4 | Heb 3:4 | 1John 4:4 | Eccl 5:4 | Rom 6:4 |
| 1John 1:5 | 1Tim 2:5 | Titus 3:5 | Rom 4:5 | 1John 5:5 | Deut 6:5 |
| Phil 1:6 | 1John 2:6 | Prov 3:6 | Phil 4:6 | Gal 5:6 | Deut 6:6 |
| Prov 1:7 | Rev 2:7 | Phil 3:7 | Phil 4:7 | 1Peter 5:7 | Gal 6:7 |
| Josh 1:8 | Eph 2:8 | Phil 3:8 | James 4:8 | Rom 5:8 | Matt 6:8 |
| 1John 1:9 | Eph 2:9 | 2Peter 3:9 | 1John 4:9 | 1Thes 5:9 | Psalms 6:9 |
| Gal 1:10 | Phil 2:10 | Mal 3:10 | 1John 4:10 | Eph 5:10 | Rom 6:10 |
| Acts 1:11 | Titus 2:11 | Rom 3:11 | Phil 4:11 | Deut 5:11 | Eph 6:11 |

TABLE 1-continued

| | | | | | |
|---|---|---|---|---|---|
| 2Time 1:12 | Col 2:12 | Eph 3:12 | Acts 4:12 | 1John 5:12 | Eph 6:12 |
| James 1:13 | 2Tim 2:13 | Col 3:13 | Phil 4:13 | Rev 5:13 | Deut 6:13 |
| John 1:14 | Phil 2:14 | Titus 3:14 | 1Thes 4:14 | Gal 5:14 | 1Cor 6:14 |
| 1Tim 1:15 | 1Peter 2:15 | 1Peter 3:15 | Heb 4:15 | Eccl 5:15 | 2Chr 6:15 |
| Rom 1:16 | 1Cor 2:16 | John 3:16 | 1John 4:16 | 1The 5:16 | Eph 6:16 |
| James 1:17 | 1John 2:17 | Col 3:17 | Col 4:17 | 1The 5:17 | Eph 6:17 |
| 1Cor 1:18 | Hebr 2:18 | Hab 3:18 | 2Cor 4:18 | 1The 5:18 | Rom 6:18 |
| James 1:19 | 2Tim 2:19 | Eph 3:19 | Phil 4:19 | Lam 5:19 | Matt 6:19 |
| Rom 1:20 | Gal 2:20 | Rev 3:20 | 1Cor 4:20 | James 5:20 | 1Cor 6:20 |
| Phil 1:21 | Gal 2:21 | 1Sam 3:21 | 1John 4:21 | Prov 5:21 | Matt 6:21 |
| Col. 1:22 | Dan 2:22 | Rom 3:22 | Mark 4:22 | John 5:22 | Luke 6:22 |
| Matt 1:23 | 1John 2:23 | Rom 3:23 | John 4:23 | 1The 5:23 | Rom 6:23 |
| 1Peter 1:24 | 1Peter 2:24 | 1John 3:24 | John 4:24 | John 5:24 | Matt 6:24 |
| 1Cor 1:25 | 1Peter 2:25 | Gal 3:25 | Rom 4:25 | Gal 5:25 | Num 6:25 |
| Genesis 1:26 | James 2:26 | Prov 3:26 | Eph 4:26 | Gal 5:26 | Dan 6:26 |
| 1Cor 1:27 | 1John 2:27 | John 3:27 | Prov 4:27 | Deut 5:27 | Matt 6:27 |
| Isaiah 1:28 | Dan 2:28 | Rom 3:28 | Gal 4:28 | Eph 5:28 | Luke 6:28 |
| John 1:29 | Rev 2:29 | Mark 3:29 | Dept 4:29 | Acts 5:29 | John 6:29 |
| 1Cor 1:30 | | John 3:30 | Eph 4:20 | John 5:30 | 2Chr 6:30 |
| Genesis 1:31 | | Lam 3:31 | | Eph 5:31 | |
| JULY | AUGUST | SEPTEMBER | OCTOBER | NOVEMBER | DECEMBER |
| Matt 7:1 | Rom 8:1 | Psalms 9:1 | Heb 10:1 | Heb 11:1 | Rom 12:1 |
| Prov 7:2 | Rom 8:2 | Job 9:2 | Zech 10:2 | Luke 11:2 | Rom 12:2 |
| Matt 7.3 | 1Cor 8:3 | John 9:3 | Lev 10:3 | Heb 11:3 | Jer 12:3 |
| Rom 7.4 | Psalms 8:4 | Dan 9:4 | Rom 10:4 | Psalms 11:4 | Heb 12:4 |
| Eccl 7.5 | Deut 8:5 | Neh 9:5 | 2Cor 10:5 | Eccl 11:5 | Isaiah 12:5 |
| Rom 7.6 | 1Cor 8:6 | Neh 9:6 | 1Sam 10:6 | Heb 11:6 | Psalms 12:6 |
| Matt 7.7 | Job 8:7 | 2Cor 9:7 | Jer 10:7 | Psalms 11:7 | Heb 12:7 |
| Matt 7:8 | Rom 8:8 | Neh 9:8 | Matt 10:8 | 2Kings 11:8 | Luke 12:8 |
| Isaiah 7:9 | 1Cor 8:9 | Psalms 9:9 | Rom 10:9 | Luke 11:9 | 2Cor 12:9 |
| Psalms 7:10 | Prov 8:10 | Psalms 9:10 | Heb 10:10 | Luke 11:10 | 2Cor 12:10 |
| 2Sam 7:11 | Deut 8:11 | Genesis 9:11 | Rom 10:11 | Matt 11:11 | Heb 12:11 |
| Matt 7:12 | John 8:12 | Heb 9:12 | Dan 10:12 | Matt 11:12 | Rom 12:12 |
| Matt 7:13 | Isaiah 8:13 | Matt 9:13 | Rom 10:13 | Luke 11:13 | Eccl 12:13 |
| 2Chr 7:14 | Rom 8:14 | Dan 9:14 | John 10:14 | 2Cor 11:14 | Heb 12:14 |
| 1Cor 7:15 | Rom 8:15 | Ezra 9:15 | Mark 10:15 | Rev 11:15 | Luke 12:15 |
| Rev 7:16 | Rom 8:16 | Rom 9:16 | Luke 10:16 | Deut 11:16 | 1Sam 12:16 |
| Psalms 7:17 | Isaiah 8:17 | Neh 9:17 | Heb 10:17 | Luke 11:17 | Mark 12:17 |
| Dan 7:18 | Rom 8:18 | Dan 9:18 | Mark 10:18 | Deut 11:18 | Rom 12:18 |
| Eze 7:19 | Rom 8:19 | 1Cor 9:19 | Heb 10:19 | Deut 11:19 | Rom 12:19 |
| Eccl 7:20 | Isaiah 8:20 | Luke 9:20 | Rom 10:20 | Deut 11:20 | Sam 12:20 |
| Deut 7:21 | Luke 8:21 | Rom 9:21 | Luke 10:21 | Prov 11:21 | Rom 12:21 |
| 2Sam 7:22 | Ezra 8:22 | Heb 9:22 | Matt 10:22 | Mark 11:22 | Prov 12:22 |
| Jer 7:23 | 1Kin 8:23 | Luke 9:23 | Heb 10:23 | Luke 11:23 | Job 12:23 |
| Matt 7:24 | John 8:24 | Jer 9:24 | Luke 10:24 | Mark 11:24 | 1Sam 12:24 |
| Hebr 7:25 | Luke 8:25 | Luke 9:25 | Mark 10:25 | John 11:25 | John 12:25 |
| Deut 7:26 | Rom 8:26 | Heb 9:26 | Matt 10:26 | Acts 11:26 | John 12:26 |
| 2Sam 7:27 | Rom 8:27 | Heb 9:27 | Mark 10:27 | Matt 11:27 | Mark 12:27 |
| Eccl 7:28 | Rom 8:28 | Heb 9:28 | John 10:28 | Matt 11:28 | Eze 12:28 |
| John 7:29 | Rom 8:29 | Matt 9:29 | Matt 10:29 | Matt 11:29 | Heb 12:29 |
| 1Cor 7:30 | Rom 8:30 | Rom 9:30 | John 10:30 | Matt 11:30 | Mark 12:30 |
| Genesis 7:31 | Rom 1:31 | | 1Cor 10:31 | | Mark 12:31 |

With reference now Table 2, it should become readily apparent that most days of the year may be represented by a multiplicity of bibliographic citations 24 for each day and date and display medium 10 therefor has a seemingly endless number of combinations of bibliographic citations 24 that may be displayed upon line 13 for inspiration, memorization or citation. In an alternate embodiment, bibliographic citations 24 may be programmed within instrument 100 to automatically change upon the change to the new year. It is within the scope of this invention to have specific bibliographic citations 24 corresponding to the day of the week for each of multiple years as it is readily apparent that a given month/date combination repeats infrequently. In table 2 below, the complete spelling, a three letter abbreviation and a two letter abbreviation for the books of the Christian Bible are shown wherein a selection of the appropriate format may be used commensurate with the available space or character length of display medium 10. Where space permits, such as on an electronic billboard or computer screen, the entire reference work name along with the specific citation from the work may be displayed along with the complete text or a toggle may be used to alternately display the complete citation and the text from the work.

TABLE 2

| Book | Abbr. | Abbr. | # of verses/chapter of the 1st 12 chapters | # chapters |
|---|---|---|---|---|
| Genesis | GEN | GE | 31,25,24,26,32,22, 24,22,29,32,32,20 | 50 |
| Exodus | EXO | EX | 22,25,22,31,23,30, 25,32,35,29,10,51 | 40 |
| Leviticus | LEV | LE | 17,16,17,35,19,30, 38,36,24,20,47,8 | 27 |
| Numbers | NUM | NM | 54,34,51,49,31,27, 89,26,23,36,35,16 | 36 |
| Deuteronomy | DEU | DU | 46,37,29,49,33,25, | 34 |

TABLE 2-continued

| Book | Abbr. | Abbr. | # of verses/chapter of the 1st 12 chapters | # chapters |
|---|---|---|---|---|
| | | | 26,20,29,22,32,32 | |
| Joshua | JOS | JS | 18,24,17,24,15,27, 26,35,27,43,23,24 | 24 |
| Judges | JDG | JD | 36,23,31,24,31,40, 25,35,57,18,40,15 | 21 |
| Ruth | RUT | RU | 22,23,18,22 | 4 |
| 1st Samuel | 1SM | 1S | 28,36,21,22,12,21, 17,21,27,27,15,25 | 31 |
| 2nd Samuel | 2SM | 2S | 27,32,39,12,25,23, 29,18,13,19,27,31 | 24 |
| 1st Kings | 1KI | 1K | 53,46,28,34,18,38, 51,66,28,29,43,33 | 22 |
| 2nd Kings | 2KI | 2K | 18,25,27,44,27,33, 20,29,37,36,21,21 | 25 |
| 1st Chronicles | 1CH | 1C | 54,55,24,43,26,81, 40,40,44,14,47,40 | 29 |
| 2nd Chronicles | 2CH | 2C | 17,18,17,22,14,42, 22,18,31,19,23,16 | 36 |
| Ezra | EZR | EZ | 11,70,13,24,17,22, 28,36,15,44 | 10 |
| Nehemiah | NEH | NE | 11,20,32,23,19,19, 73,18,38,39,36,47 | 13 |
| Esther | EST | ES | 22,23,15,17,14,14, 10,17,32,3 | 10 |
| Job | JOB | JO | 22,13,26,21,27,30, 21,22,35,22,20,25 | 42 |
| Psalms | PSA | PS | 6,12,8,8,12,10,17, 9,20,18,7,8 | 150 |
| Proverbs | PRO | PR | 33,22,35,27,23,35, 27,36,18,32,31,28 | 31 |
| Ecclesiastes | ECC | EC | 18,26,22,16,20,12, 29,17,18,20,10,14 | 12 |
| Solomon | SOL | SO | 17,17,11,16,16,13, 13,14 | 8 |
| Isaiah | ISA | IS | 31,22,26,6,30,13, 25,22,21,34,16,6 | 66 |
| Jeremiah | JER | JE | 19,37,25,31,31,30, 34,22,26,25,23,17 | 52 |
| Lamentations | LAM | LA | 22,22,66,22,22 | 5 |
| Ezekiel | EZE | EZ | 28,10,27,17,17,14, 27,18,11,22,25,28 | 48 |
| Daniel | DAN | DN | 21,49,30,37,31,28, 28,27,27,21,45,13 | 12 |
| Hosea | HOS | HS | 11,23,5,19,15,11, 16,14,17,15,12,14 | 14 |
| Joel | JOL | JL | 20,32,21 | 3 |
| Amos | AMO | AM | 15,16,15,13,27,14, 17,14,15 | 9 |
| Obadiah | OBA | OB | 21 | 1 |
| Jonah | JOH | JH | 17,10,10,11 | 4 |
| Micah | MIC | MI | 16,13,12,13,15,16,20 | 7 |
| Nahum | NAH | NA | 15,13,19 | 3 |
| Habakkuk | HAB | HA | 17,20,19 | 3 |
| Zephaniah | ZEP | ZE | 18,15,20 | 3 |
| Haggai | HAG | HG | 15,23 | 2 |
| Zechariah | ZEC | ZE | 21,13,10,14,11,15, 14,23,12,17,14 | 14 |
| Malachi | MAL | ML | 14,17,18,6 | 4 |
| Matthew | MAT | MA | 25,23,17,25,48,34, 29,34,38,42,30,50 | 28 |
| Mark | MAR | MR | 45,28,35,41,43,56, 37,38,50,52,33,44 | 16 |
| Luke | LUK | LU | 80,52,38,44,39,49, 50,56,62,42,54,59 | 24 |
| John | JON | JN | 51,25,36,54,47,71, 53,59,41,42,57,50 | 21 |
| Acts | ACT | AC | 26,47,26,37,42,15, 60,40,43,48,30,25 | 28 |
| Romans | ROM | RO | 32,29,31,25,21,23, 25,39,33,21,36,21 | 16 |
| 1st Corinthians | 1CO | 1O | 31,16,23,21,13,20, 40,13,27,33,34,31 | 16 |
| 2nd Corinthians | 2CO | 2O | 24,17,18,18,21,18, 16,24,15,18,33,21 | 13 |
| Galatians | GAL | GA | 24,21,29,31,26,18 | 6 |
| Ephesians | EPH | EP | 23,22,21,32,33,24 | 6 |

TABLE 2-continued

| Book | Abbr. | Abbr. | # of verses/chapter of the 1st 12 chapters | # chapters |
|---|---|---|---|---|
| Philippians | PHI | PH | 30,30,21,23 | 4 |
| Colossians | COL | CL | 29,23,25,18 | 4 |
| 1st Thessolonians | 1TH | 1T | 10,20,13,18,28 | 5 |
| 2nd Thessolonians | 2TH | 2T | 12,17,18 | 3 |
| 1st Timothy | 1TM | 1M | 20,15,16,16,25,21 | 6 |
| 2nd Timothy | 2TM | 2M | 18,26,17,22 | 4 |
| Titus | TTS | TT | 16,15,15 | 3 |
| Philemon | PHL | PL | 25 | 1 |
| Hebrews | HEB | HB | 14,18,19,16,14,20, 28,13,28,39,40,29 | 13 |
| James | JAM | JM | 27,26,18,17,20 | 5 |
| 1st Peter | 1PE | 1P | 25,25,22,19,14 | 5 |
| 2nd Peter | 2PE | 2P | 21,22,18 | 3 |
| 1st John | 1JN | 1J | 10,29,24,21,21 | 5 |
| 2nd John | 2JN | 1J | 13 | 1 |
| 3rd John | 3JN | 2J | 15 | 1 |
| Jude | JUD | JU | 25 | 1 |
| Revelation | REV | RE | 20,29,22,11,14,17, 17,13,21,11,19,18 | 22 |

For instance, there are nearly enough verses in the first twelve chapters of Genesis to have an electronic reference work creation story, selected references from other books inserted to complete the number of days for each month. Likewise, there are nearly enough verses in Exodus for that portion of history to be electronically displayed on display medium 10. A "trials and tribulations" display medium 10 may be created using the book of Job and, likewise, the Gospels may comprise separate works detailing the life of Jesus for display, reference, memorization and inspiration.

Though the Christian Bible has been cited as the reference work having text 23 to be displayed upon display medium 10 of instrument 100, other reference works may be used to advantage as well. Additionally, various versions of the Christian Bible may be used for text 23, such as the King James Version, English Revised Version, American Standard Version, New American Standard Version, New International Version, Authorized Version, Revised Standard Version, Jerusalem Bible, Douay Bible, Good News Bible and others, including other translations from Greek, Aramaic, Syriac, Latin and Hebrew or in any of the different languages in which these references have been published or combinations thereof. Toggle between various translations might be accomplished, for instance, by depressing and holding control button 14. It would also be within the scope of this invention to first depress control button 15 and thereafter repeatedly depressing control button 14 to display alternate verses or employ other combinations of control buttons 14-17 to toggle between different translations or different languages. It is within the scope of this invention to include bibliographic citations of other religious works which are annotated into chapters and verses including, but not limited to, Biblia Hebraica, Septuagint, Apocrypha, Vulgate, Koran, Hebrew, Greek and to embed text 23 from those religious works into an electronic chip for use with instrument 100 and to cite the reference work, chapter and verse on display medium 10 in print wherein bibliographic citation 24 corresponds to the month/day/date line 13. It is also within the scope of this invention to include poetry and prose of a number of known authors which is often displayed with lines numbers wherein the line numbers may be displayed upon line 13 along with a representation of the work and wherein an electronic chip within instrument 100 has text 23 thereof contained therewithin. For instance, Act one, Scene two, line 18 from Shakespeare's *The Tragedy of Julius Caesar* could be represented with Cel in text display 31 for Act one of the cited work, with 2:18 in daily display 32 representing Scene 2, line 18. Additionally, art work of the Masters may be assigned numbers for the days of the month and be displayed on daily display 32 or on a larger instrument 100 such as upon the screen of a computer wherein the name of each Master is also displayed or abbreviated as text display 31. In another embodiment, instrument 100 may contain a recording device wherein sound transcriptions from the great composers may be recorded and the bibliographic citation 24 such as Beethoven's ninth, Opus 26 may be displayed upon line 13 of display medium 10 as Bth 9:26 corresponding to September the $26^{th}$ and thus electronic chip of instrument 100 would contain at least 366 different musical recordings for reference by the user of instrument 100. Of course, it is also within the scope of this invention to provide text 23 of religious works as audible output from instrument 10 in place of, or in addition to, printed text 23 on face 22 of display medium 10 and to provide for changeable language versions of text 23. For instance, after toggling from bibliographic reference 24 to text 23, the user of instrument 100 may also receive an audio reading of the selected verse by depressing and holding control buttons 14 and 15. Of course, other combinations of control buttons 14-17 may be used to toggle between audio and printed text. In one embodiment, instrument 100 may have a replaceable electronic chip or data card, each replaceable electronic data chip or card containing different bibliographic citations 24 and associated text 23 or displays or recordings thereupon for use by the user of instrument 100. For instance, poetry may be contained on one replaceable card, religious text on another, classics on another and sound recordings on another. Thus, it may be seen that line 13 of instrument 100 may be used by a variety of persons for inspiration, study or entertainment. It is also within the scope of this invention to provide a combination of artwork, text 23 and electronic sound recordings wherein bibliographic citation 24 of text 23 is displayed in alpha designation 18 while the artwork and electronic sound recording also correspond to numeric designation 19 of daily display 32.

Figure 5:
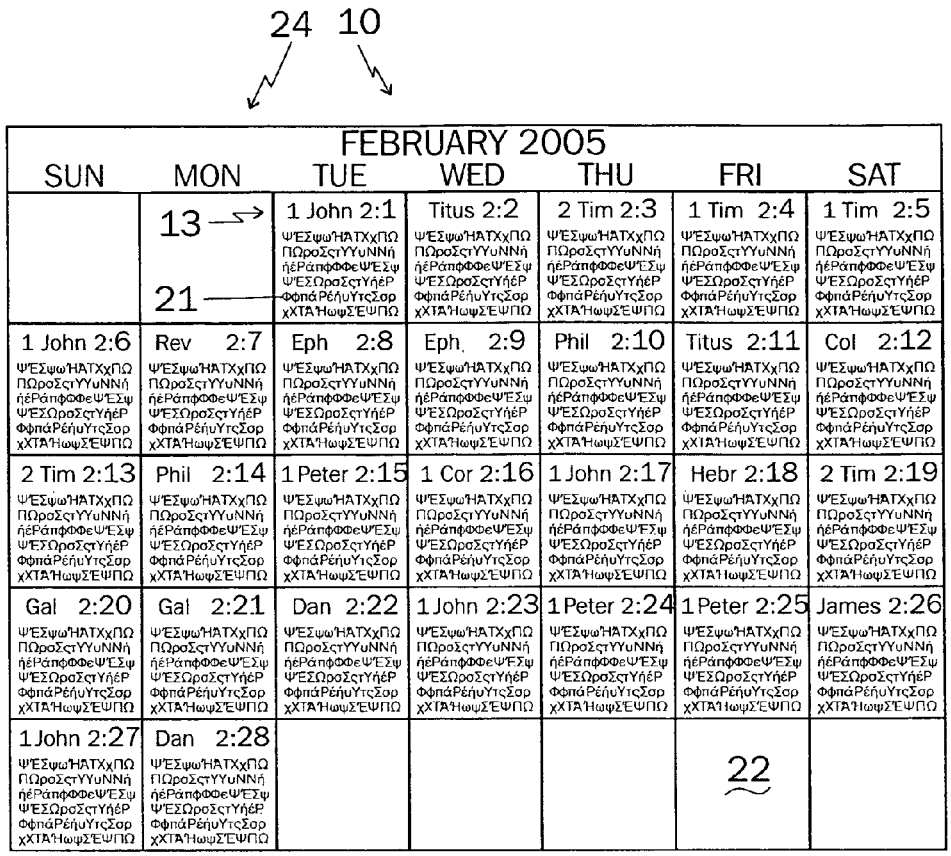
FIG. 5 is a plan view of a wall calendar showing a bibliographic reference corresponding to every date of the month displayed and the text of the cited bibliographic reference appearing as Greeking within the space provided for the date.
Figure 4:
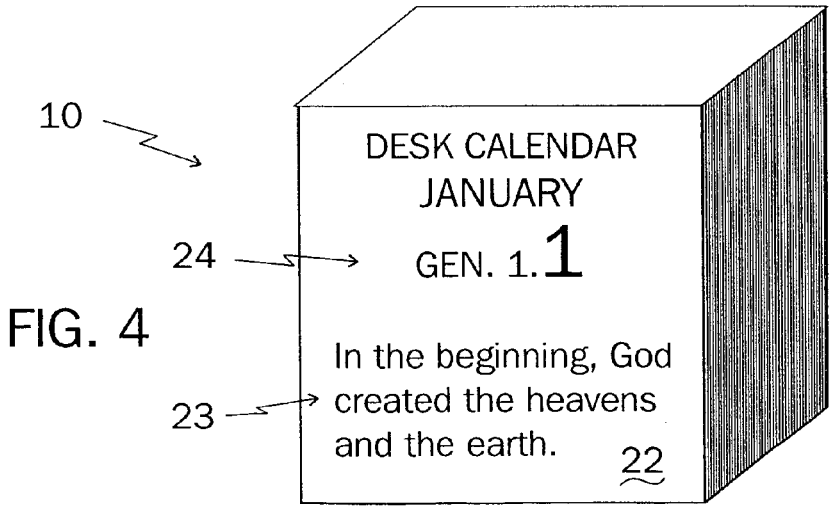
FIG. 4 is a perspective view of a daily desk calendar showing a bibliographic reference corresponding to the date with the text of the bibliographic reference appearing below the citation.

In another embodiment, a print calendar such as a wall calendar shown in FIG. 5 or the desk calendar of FIG. 4 may contain bibliographic citation 24 in the same manner as displayed on LCD 11, however, it should be readily apparent that each bibliographic citation 24 on a print medium is restricted to the cover space of the day. For instance, in the small square represented for each of the days of the week displayed in the wall calendar of FIG. 5, it would be preferable that only a single bibliographic citation 24 and text 23 corresponding to the exact date of the month and the month of the year be shown due to the limited space on the print calendar square. On a larger display medium 10 such as the desktop calendar as in FIG. 4 having a flip page display, it may be possible to include more bibliographic citations 24 on the face 22 of the display medium 10, however, again it is preferred that at a single bibliographic citation 24 be displayed thereon for use by the user of the desktop calendar for inspiration, memorization or citation. Though sound recordings cannot be reproduced on a print medium, it is within the scope of this invention to utilize the space provided for each day/month and day of year to display a work of art, sonnet, poem or text of a song consistent with the copyright laws.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A daily desk calendar comprising a plurality of separate sheets stacked together, said plurality of separate sheets each displaying a month of a year of a Gregorian calendar and at least one day of said month of said year, each of said plurality of separate sheets also carrying a different bibliographic citation of portions of a text reference work, said bibliographic citation comprising at least one numeric designation corresponding to a specific location within said portion of said text reference work, wherein a numeric designation of each of said months of said year corresponds to a different portion of said text reference work and each numeric designation of said day of said month corresponds to said numeric designation of said bibliographic citation.

2. A daily desk calendar as in claim 1 wherein said text reference work is selected from the group comprising religious works, musical scores, poetry, prose, plays and the classics.

3. A daily desk calendar as in claim 2 wherein each of said plurality of sheets consists of a display of all days of said month.

4. A daily desk calendar as in claim 3 wherein said specific location within said portion is a verse of a chapter of a book of a religious text.

5. A daily desk calendar as in claim 3 wherein said specific location within said portion is a line of said text reference work.

6. A daily desk calendar as in claim 2 wherein said plurality of separate sheets carries at least a portion of text of said bibliographic citation of said text reference work.

7. A daily desk calendar as in claim 1 wherein each of said plurality of sheets consists of a display of separate days of said month.

8. A daily desk calendar as in claim 7 wherein said specific location within said portion is a verse of a chapter of a book of a religious text.

9. A daily desk calendar as in claim 8 wherein said specific location within said portion is a line of said text reference work.

10. A daily desk calendar as in claim 7 wherein each of said plurality of separate sheets carries text of said bibliographic citation of said text reference work.

* * * * *